US008960093B2

(12) United States Patent
Preiss et al.

(10) Patent No.: US 8,960,093 B2
(45) Date of Patent: Feb. 24, 2015

(54) IGNITER WITH A MULTIFUNCTIONAL PLUG

(75) Inventors: Frank Haron Preiss, Bonn (DE); Rolf Rospek, Edemissen (DE); Malte Veehmayer, Siegburg (DE)

(73) Assignee: Dynaenergetics GmbH & Co. KG (DE)

( * ) Notice: Subject to any disclaimer, the term of this patent is extended or adjusted under 35 U.S.C. 154(b) by 0 days.

(21) Appl. No.: 14/111,310

(22) PCT Filed: Apr. 12, 2012

(86) PCT No.: PCT/EP2012/056609

§ 371 (c)(1),
(2), (4) Date: Oct. 11, 2013

(87) PCT Pub. No.: WO2012/140102

PCT Pub. Date: Oct. 18, 2012

(65) Prior Publication Data

US 2014/0033939 A1 Feb. 6, 2014

(30) Foreign Application Priority Data

Apr. 12, 2011 (DE) ..... 10 2011 016 756

(51) Int. Cl.
*F42D 1/04* (2006.01)
*F42D 3/06* (2006.01)
(Continued)

(52) U.S. Cl.
CPC ..... *F42D 1/043* (2013.01); *F42B 3/103* (2013.01); *F42B 3/182* (2013.01); *F42B 3/24* (2013.01); *F42B 3/26* (2013.01); *F42C 19/06* (2013.01); *F42D 3/04* (2013.01); *F42D 3/06* (2013.01);
(Continued)

(58) Field of Classification Search
USPC ..... 102/200, 202, 202.5–202.14, 275.11, 102/275.12, 333; 439/395, 404
See application file for complete search history.

(56) References Cited

U.S. PATENT DOCUMENTS 1,868,224 A 4/1932 Schuermann
3,173,992 A * 3/1965 Boop ..... 174/151
(Continued)

FOREIGN PATENT DOCUMENTS

DE 9204340 U1 6/1992
DE 60103321 T2 6/2005
(Continued)

OTHER PUBLICATIONS

International Search Report for PCT/EP2009/066509 dated Apr. 16, 2010 in English.
(Continued)

*Primary Examiner* — Bret Hayes
(74) *Attorney, Agent, or Firm* — Lisa J. Moyles

(57) ABSTRACT

An igniter for seismic prospection or for mining applications or for use in the crude oil and natural gas industries is described, including a detonator in which an explosive material, an igniting element and internal wires for initiating the igniting element are arranged, wherein the internal wires lead into a plug which is arranged at one end of the detonator. In order for the user of the igniter to be able to introduce external wires into the plug without having to strip the wires of insulation beforehand, and, in the plug, for the internal wires to be electrically connected to the external wires, without the external wires requiring any plug and socket connector or mating part of a plug and socket connector, the plug is designed as a multifunctional plug.

10 Claims, 9 Drawing Sheets

(51) Int. Cl.

| | |
|---|---|
| ***F42B 3/10*** | (2006.01) |
| ***F42C 19/12*** | (2006.01) |
| ***F42B 3/103*** | (2006.01) |
| ***F42B 3/182*** | (2006.01) |
| ***F42B 3/24*** | (2006.01) |
| ***F42B 3/26*** | (2006.01) |
| ***F42C 19/06*** | (2006.01) |
| ***F42D 3/04*** | (2006.01) |
| ***H01R 4/24*** | (2006.01) |
| *H01R 13/703* | (2006.01) |

(52) U.S. Cl.

CPC ..... *H01R 4/2433* (2013.01); *H01R 13/7036* (2013.01)

USPC ..... 102/333; 102/202.5; 102/202.14

(56) References Cited

U.S. PATENT DOCUMENTS

| | | | | |
|---|---|---|---|---|
| 3,244,103 | A * | 4/1966 | Spickard | 102/202.5 |
| 3,580,171 | A | 5/1971 | Maes | |
| 4,000,696 | A | 1/1977 | Friant et al. | |
| 5,064,382 | A * | 11/1991 | Minnis | 439/395 |
| 5,605,470 | A | 2/1997 | Braithwaite et al. | |
| 5,955,699 | A * | 9/1999 | Perotto et al. | 102/530 |
| 6,328,592 | B1 * | 12/2001 | Burke et al. | 439/417 |
| 6,500,027 | B1 * | 12/2002 | Van Der Sanden et al. | 439/587 |
| 6,752,083 | B1 * | 6/2004 | Lerche et al. | 102/202.7 |
| 2002/0013081 | A1 * | 1/2002 | Shan | 439/395 |
| 2002/0055294 | A1 * | 5/2002 | Murakami et al. | 439/395 |

FOREIGN PATENT DOCUMENTS

| | | | |
|---|---|---|---|
| DE | 102009056937 | A1 | 7/2010 |
| DE | 102011015052 | A1 | 12/2011 |
| EP | 1139060 | B1 | 5/2004 |
| EP | 1662224 | A1 | 5/2006 |
| EP | 2290749 | A1 | 3/2011 |
| FR | 1123291 | B | 9/1956 |
| FR | 1216794 | A1 | 4/1960 |
| WO | WO9727649 | A1 | 7/1997 |
| WO | WO03004960 | A1 | 1/2003 |
| WO | WO2007118707 | A1 | 10/2007 |
| WO | WO2010066672 | A1 | 6/2010 |
| WO | WO2011117337 | A1 | 9/2011 |

OTHER PUBLICATIONS

International Preliminary Report on Patentability for PCT/EP2009/066509 dated Jun. 14, 2011 in English.

International Search Report for PCT/EP2011/054517 dated Jun. 28, 2011 in English.

International Preliminary Report on Patentability for PCT/EP2011/054517 dated Sep. 25, 2012 in English.

International Search Report for PCT/EP2012/056609 dated Jul. 11, 2012 in English.

International Preliminary Report on Patentability for PCT/EP2012/056609 dated Oct. 15, 2013 in English.

* cited by examiner

IGNITER WITH A MULTIFUNCTIONAL PLUG

CROSS-REFERENCE TO RELATED APPLICATIONS

This application claims priority to PCT Application No. PCT/EP2012/056609, filed Apr. 12, 2012, which claims priority to German Patent Application No. 102011016756.0, filed Apr. 12, 2011, each of which are incorporated herein by reference in their entirety.

FIELD OF THE INVENTION

The invention relates to an igniter for seismic prospection, for mining applications, or for use in the crude oil or natural gas industry, having a detonator in which an explosive material, an igniting element, and internal wires for initializing the igniting element are situated, the internal wires leading into a plug situated at one end of the detonator.

BACKGROUND OF THE INVENTION

Igniters for seismic prospection or mining applications are produced by the manufacturer nowadays in prefabricated lengths of wire (generally between 1 m and 75 m long, and either folded or wound onto spools) and sold to the customer.

Alternatively, it is possible to provide the igniter with a plug, which is designed as a plug-in connector. The wire of prefabricated length, which is provided with the mating part of the plug-in connector, is then supplied to fit this plug-in connector.

BRIEF DESCRIPTION OF THE INVENTION

The object of the invention is to improve an igniter in such a way that the user is able to easily introduce external wires into the plug without having to strip the wires of insulation beforehand, and for the electrical connection of the internal wires with the external wires to be established in the plug. The aim is that the external wires do not have a plug-in connector or the mating part of a plug-in connector. The need for the external wire to be prefabricated is thus avoided.

In one refinement of the invention, the internal wires of the igniter in the transport state should have a short circuit, which compensates for possible differences in electrical potential during the connection process, and which in the use state is open, i.e., ready to use. In addition, the igniter in the use state should be impervious to liquid.

According to the invention, this object is achieved in that the plug is a multifunctional plug, and has a) a plug base body and a plug cover which is displaceable in the plug base body, the plug cover being displaceable from a first actuating stage into a second actuating stage, b) receiving channels situated in the plug base body for introducing external wires, c) pressure plungers situated on the plug cover, which in the first actuating stage do not protrude into the receiving channels, but which in the second actuating stage protrude into the receiving channels and displace an external wire, introduced at that location, perpendicularly with respect to the receiving channels, d) a slot-shaped blade contact which protrudes into each of the receiving channels, the blade contacts being connected to the internal wires, and in the second actuating stage the pressure plungers pushing the external wires into the blade contacts in such a way that the blade contacts strip the insulation from the external wires and establish an electrical connection of the external wires with the internal wires.

Due to the design of the plug as a multifunctional plug having a first actuating stage and a second actuating stage, and the mentioned properties of the multifunctional plug, the user may easily introduce external wires into the multifunctional plug without having to strip the wires of insulation beforehand, and may establish the electrical connection of the internal wires with the external wires by actuating the plug cover. The external wires do not need to have a plug-in connector or the mating part of a plug-in connector. It is thus ensured that the external wire does not have to be prefabricated.

In one refinement of the invention, a shorting jumper is situated in the plug base body, and in the first actuating stage short-circuits the internal wires and/or the associated blade contacts, and in the second actuating stage a short-circuit plunger situated on the plug cover releases the shorting jumper from the internal wires and/or the associated blade contacts and eliminates the short circuit. The internal wires of the igniter in the transport state thus have a short circuit which compensates for possible differences in electrical potential during the connecting process, and in the use state is open, i.e., ready to use.

In one preferred embodiment, the shorting jumper is spring-loaded, or is a spring element which in the second actuating stage is pushed away from the electrical contact by the short-circuit plunger against the elastic force thereof. Shorting jumpers of this type are totally secure, and also do not lose their properties after periods of extended storage.

In one preferred embodiment, the plug cover has circumferential grooves on its peripheral surface for accommodating sealing rings, which seal the plug cover with respect to the plug base body. This seal prevents liquid from reaching the multifunctional plug.

In one preferred embodiment, the plug cover and the plug base body have a cylindrical design. The multifunctional plug thus fits the igniter, which generally also has a cylindrical design. In addition, the plug cover may thus be easily guided in the plug base body.

In one preferred embodiment, the plug cover has a function plunger by means of which the plug cover is guided in the plug base body, and on its side facing away from the plug base body the function plunger has an actuating plate which abuts against the plug base body in the second actuating stage. A stop is provided as a result of the abutment against the plug base body in the second actuating stage.

In one preferred embodiment, the pressure plungers and the short-circuit plunger are situated on the side of the function plunger facing the plug base body, and the actuating plate is situated on the other side. As a result, the function plunger on the one hand is a support for the plunger, and on the other hand supports the actuating plate, i.e., the stop for the second actuating stage.

To ensure the electrical connection, at least one pressure plunger is situated in each case in front of and behind the blade contact in the direction of the receiving channels. In particular, four pressure plungers are provided, i.e., two pressure plungers for each external wire, one in front of and one behind the blade contact.

In one embodiment of the invention, the plug base body is filled with a water-repellent, gel-like medium for protection against penetrating moisture. This medium on the one hand must allow the actuation of the plug cover together with its plungers, and on the other hand must fill the interior of the plug base body so that the igniter is impervious to liquid in the use state.

The plug base body and the plug cover are preferably plastic parts which are easy to manufacture.

The invention thus describes a multifunctional plug for a standard electrical or electronic igniter, which is used in the fields of mining, seismology, or oil and gas. The multifunctional plug is intended to connect standard unstripped wires to the electrical or electronic components. The multifunctional plug is characterized in that neither the multifunctional plug nor the wires is/are provided with a coupling, a plug, or a socket.

The multifunctional plug fulfills the following functions:

Short circuit in the transport state;

Electrical connection of unstripped fed external wires;

Compensation of a possible voltage potential of the fed external wires;

Opening of the short circuit for the use state;

Sealing of the electrical connection against moisture.

BRIEF DESCRIPTION OF THE FIGURES

A more particular description of the invention briefly described above will be rendered by reference to specific embodiments thereof that are illustrated in the appended drawings in which the described functions are technically carried out as follows.

DETAILED DESCRIPTION

Figure 1:
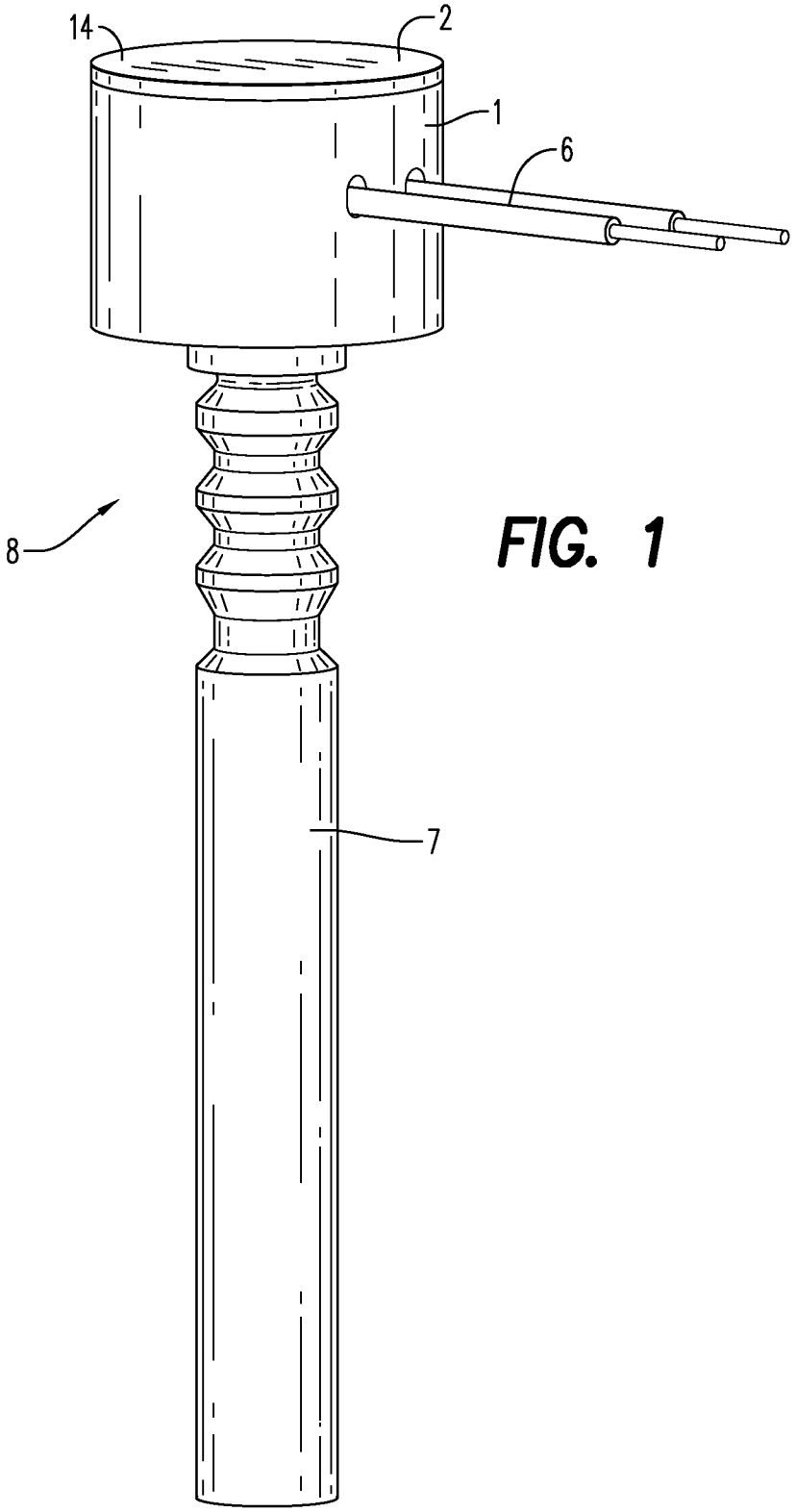
FIG. 1 shows the complete igniter having a multifunctional plug and wires.
Figure 2A:
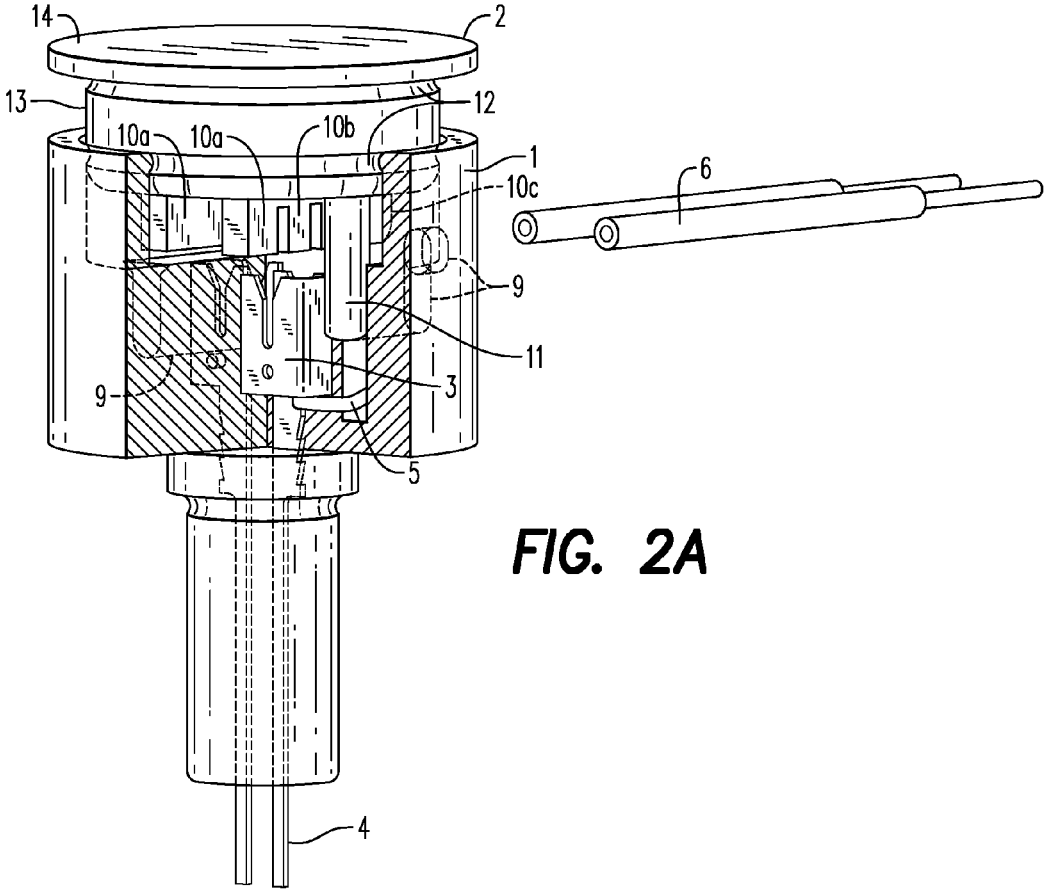
FIGS. 2A and 2B show the nonactuated multifunctional plug in the transport state, having a short circuit.
Figure 2B:
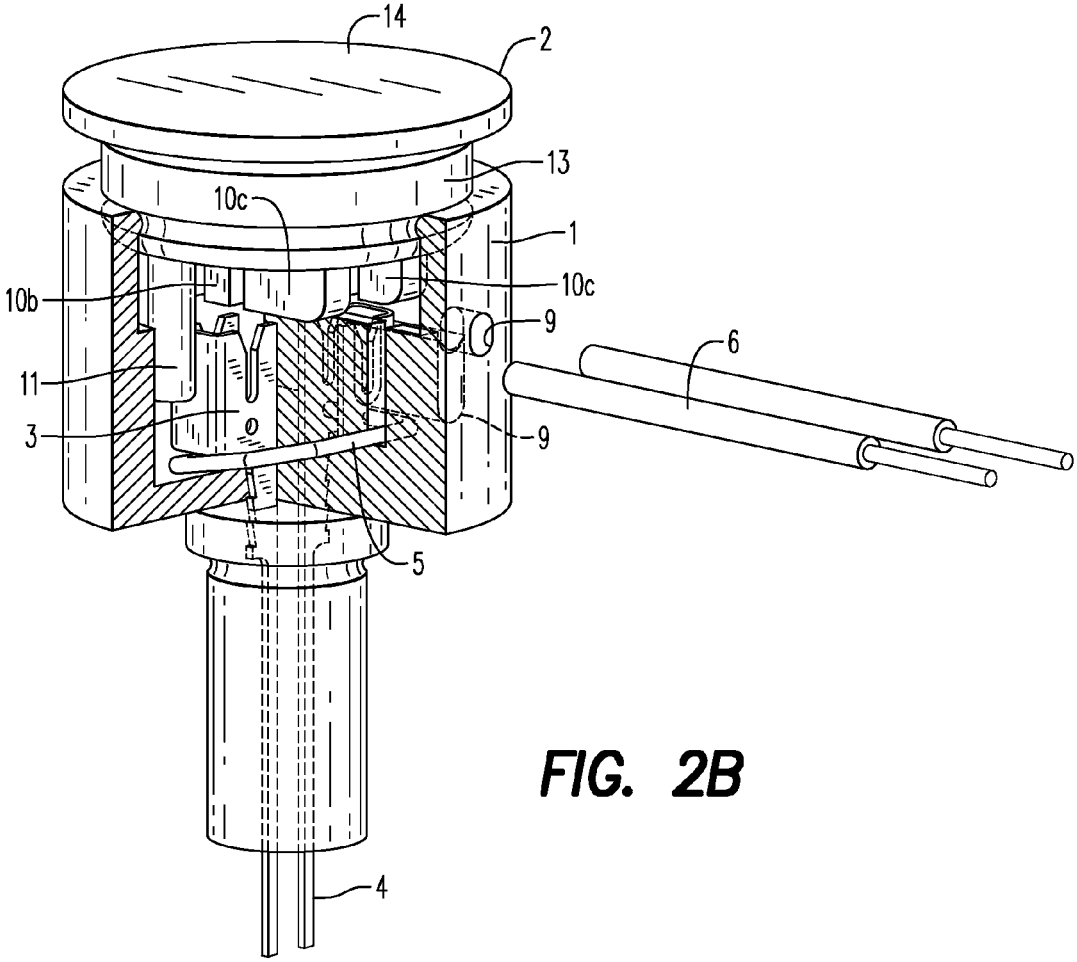

FIG. 1 shows the complete igniter 8. The detonator 7, the plug base body 1, the plug cover 2, and the external wires 6 which are introduced into the multifunctional plug 1, 2 are visible. Each of FIGS. 2 through 5 shows the same multifunctional plug of the igniter in detail, one figure differing from the others solely by a rotation of the viewing angle by 90° about the longitudinal axis. For instance, FIG. 2B shows an exploded cut-away perspective view of FIG. 1, and FIG. 2A shows FIG. 2B rotated at an angle of 90° about the longitudinal axis, depicting a different cut-away portion view.

Compared to conventional igniters, the multifunctional plug of the igniter 8 according to the invention is designed in such a way that it is possible to connect external wires 6 of any desired length (the wires are preferably cylindrical wires) without having to strip the external wires 6 of insulation beforehand, and without the external wires 6 being provided with plug-in connectors. While the igniter 8 is in the transport state or the stored state, the internal wires 4, which are connected to blade contacts 3, are connected to one another inside the plug base body 1 via a shorting jumper 5, and are thus short-circuited (see FIGS. 2A and 2B). The risk of a voltage potential between the internal wires 4 is thus excluded. A mechanical lock or some other type of lock (not shown) may optionally also be present during transport so that this short circuit cannot be interrupted by force or improper handling. FIGS. 2A and 2B show the multifunctional plug in its transport state or stored state.

Figure 3A:
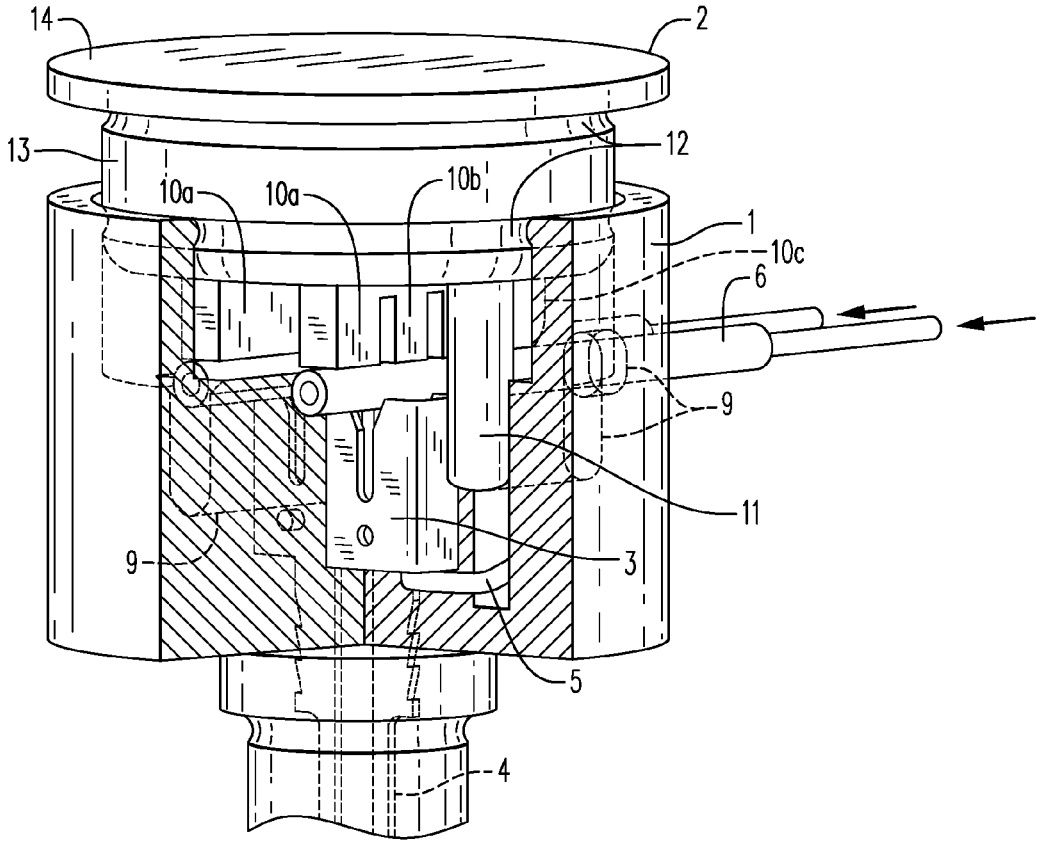
FIGS. 3A and 3B show the nonactuated multifunctional plug in the transport state, having a short circuit and introduced wires.
Figure 3B:
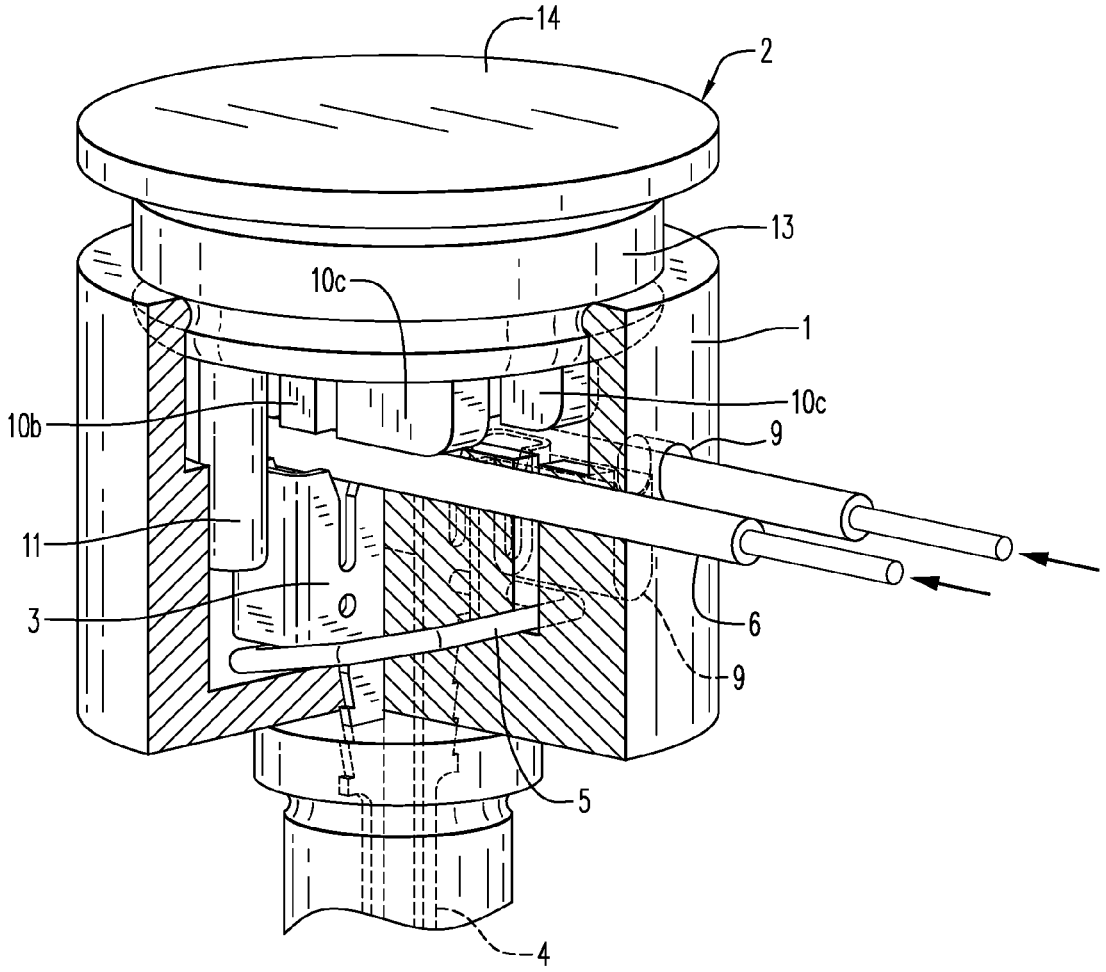

During use of the igniter 8 and after removal of the optional lock, two external wires 6 are manually introduced into each receiving channel 9, extending through the plug base body 1 (see FIGS. 3A and 3B). In the embodiment shown here, the multifunctional plug is composed of a cylindrical plug base body 1 and a cylindrical plug cover 2, which is displaceable in the plug base body 1. The plug cover 2 is composed of a function plunger 13, whereby pressure plungers 10*a*, 10*b*, and 10*c* and a short-circuit plunger 11 are situated on the side facing the plug base body 1, and an actuating plate 14 is situated on the function plunger 13 on the opposite side, and protrudes beyond the plug base body 1 and acts as a stop. The plug cover 2 is guided with its function plunger 13 in the cylindrical plug base body 1, and is displaceable from a first actuating stage into a second actuating stage.

The pressure plungers 10*a*, 10*b*, and 10*c* on the function plunger 13 do not protrude into the receiving channels 9 in which the external wires 6 are inserted. In this stage or this state, the internal wires 4 are connected to one another via a shorting jumper 5. In this state, the plug cover 2 protrudes farthest beyond the plug base body 1.

In the first actuating stage (see FIGS. 4A and 4B), which is achieved by a first pushing of the plug cover 2 or its function plunger 13 into the plug base body 1, the pressure plungers 10*a*, 10*b*, 10*c* situated on the function plunger 13 of the plug cover 2 are pushed into the receiving channels 9. In the process, the pressure plungers 10*a*, 10*b*, 10*c* push a partial section of an external wire 6, introduced at that location, perpendicularly with respect to the longitudinal axis of the receiving channels 9.

A slot-shaped blade contact 3 is situated in each of the two receiving channels 9, the blade contacts 3 being connected to the internal wires 6 in an electrically conductive manner. As shown herein, the slot-shaped blade contact 3 includes a front face and a back face, and a side face joining a side edge of the front face to a side edge of the back face, forming a u-shaped channel between the front face and the back face. Additionally, the front face includes a slotted portion extending from an upper surface, with a grooved portion extending from the slotted portion. The back face has a complementary design to the front face. Also as shown, the receiving channels 9 extending through the plug base body are arranged to align the external wires 6 with the respective blade contact 3 upon insertion of the external wires 6 through the plug base body 1. In this first actuating stage, the pressure plungers 10*a*, 10*b*, 10*c* push the external wires 6 into the blade contacts 3 in such a way that the blade contacts 3 strip the insulation from the external wires 6 and establish an electrical connection of the external wires 6 with the internal wires 4.

In the second actuating stage (see FIGS. 5A and 5B), the plug cover 2 is pushed further into the plug base body 1 until the actuating plate 14 abuts against the plug base body 1. The short-circuit plunger 11 thus pushes the shorting jumper 5 away from the electrical contact, so that the short circuit is eliminated. The igniter is then ready to use.

Figure 4A:
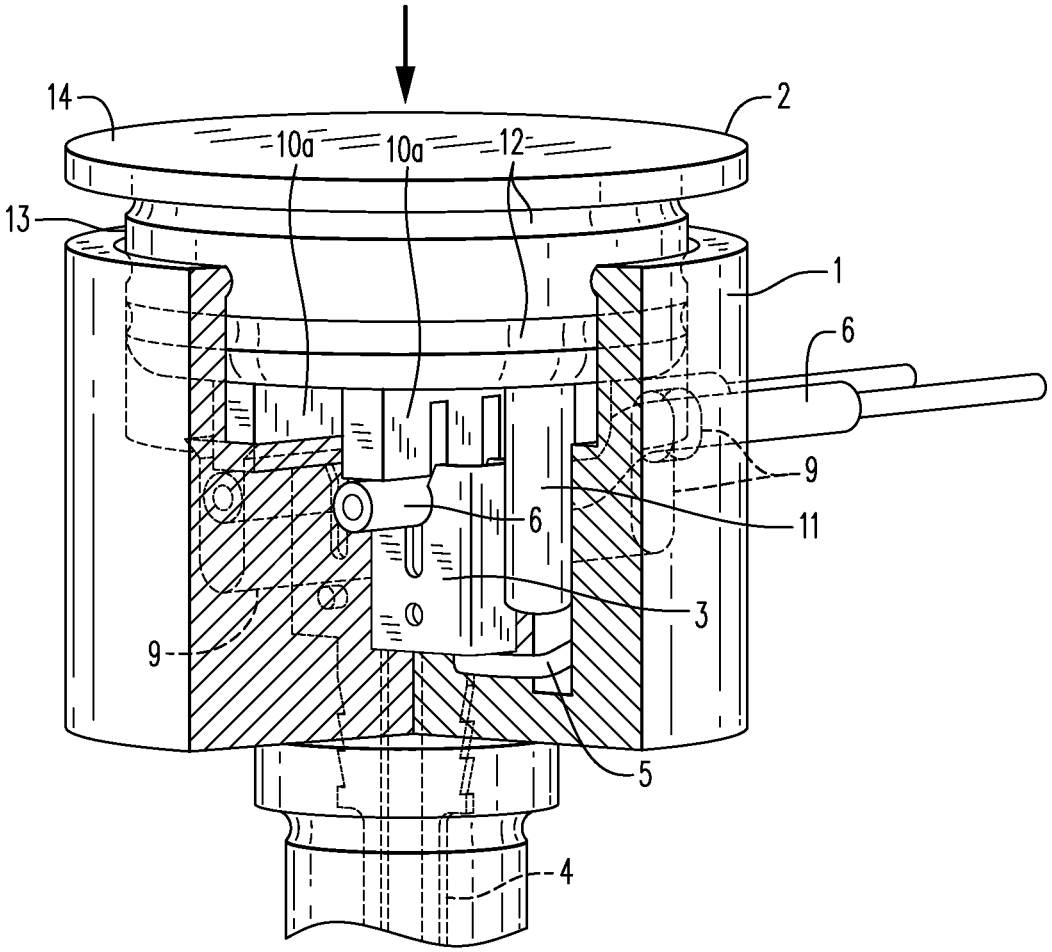
FIGS. 4A and 4B show the multifunctional plug during the actuating process, with connected wires having a short circuit (in this phase of the actuating process, the possible voltage potential of the fed wires is compensated for via the shorting jumper, which is still closed)
Figure 4B:
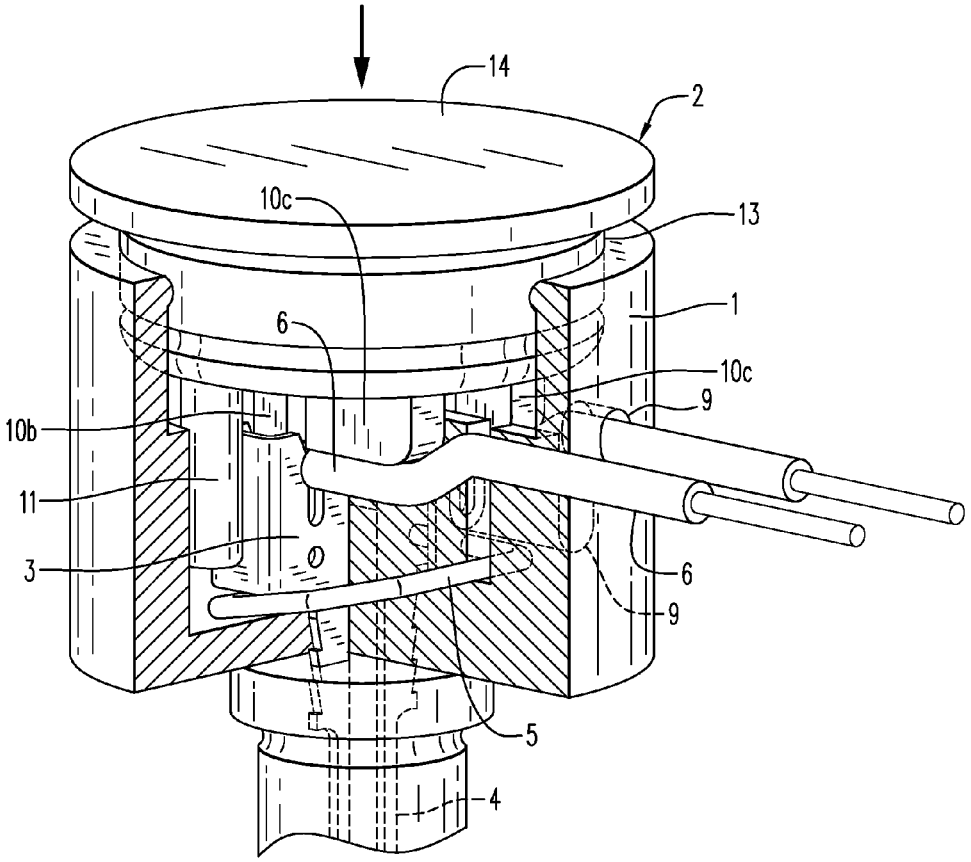
Figure 5A:
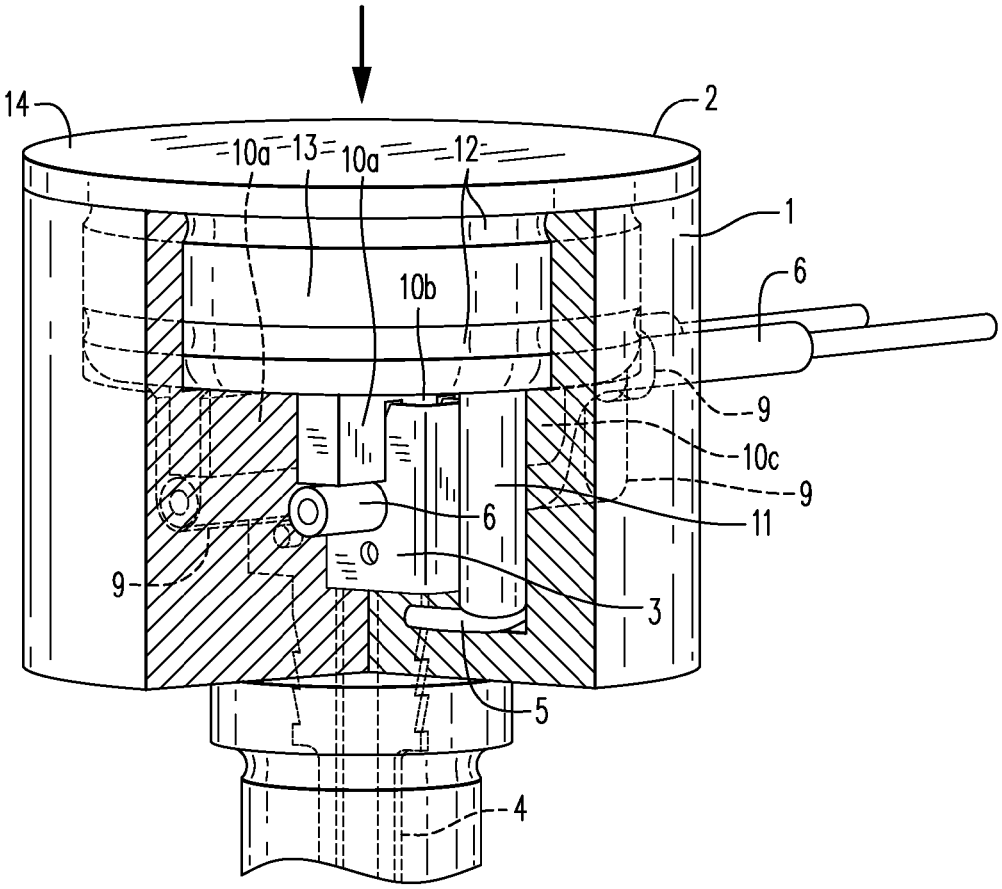
FIGS. 5A and 5B show the plug in the use state with the shorting jumper open.
Figure 5B:
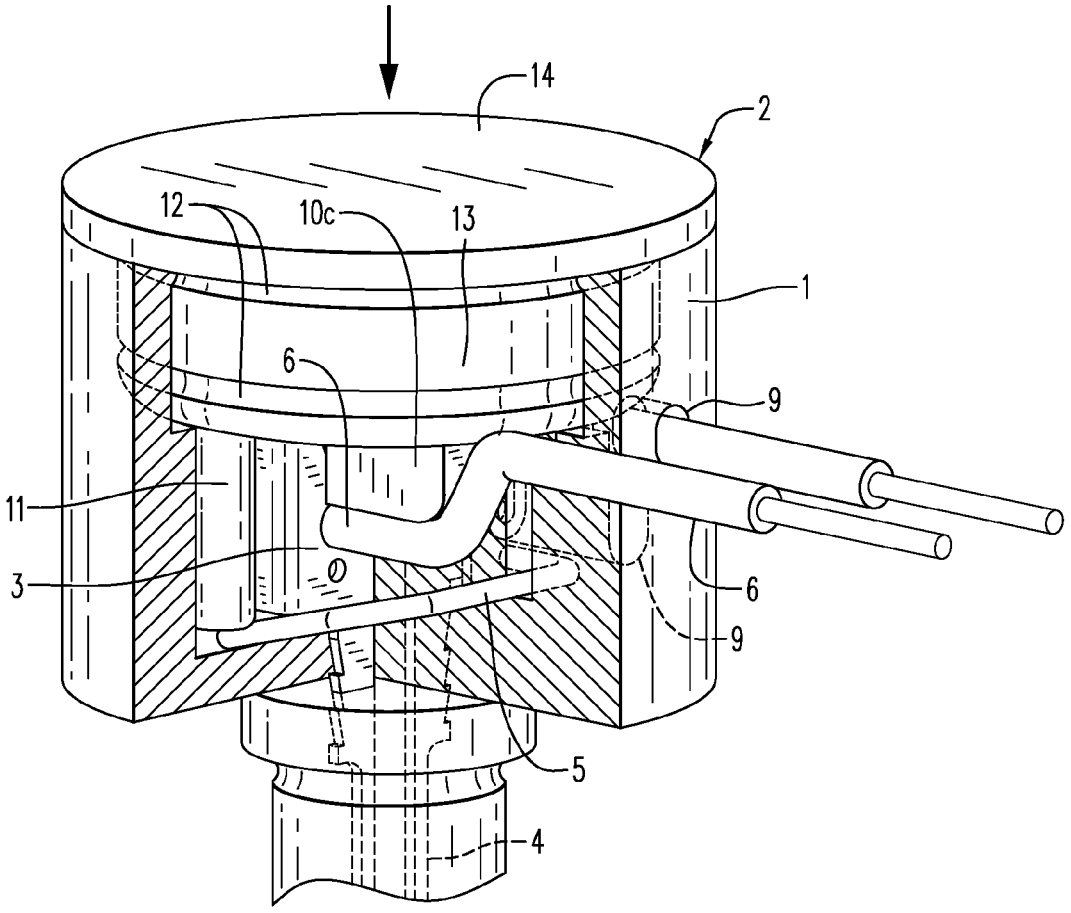

In the described closing process of the multifunctional plug, in a first stage an electrical connection is thus established between the blade contacts 3 or the internal wires 4 and the two external wires 6 (see FIGS. 4A and 4B). During the closing process, in this first actuating stage any voltage potential between the external wires 6 are compensated for by the shorting jumper 5. In the second actuating stage of the closing process, the shorting jumper 5 is open and the short circuit is eliminated (FIGS. 5A and 5B).

Stripping the two external wires 6 of insulation beforehand is not necessary. In the closed state, the igniter or detonator is insulated against moisture and is pressure-tight, as is the case for conventional igniters or detonators.

The closing process is explained once more:

State 1: The closing process of the igniter 8 or detonator is carried out by pressing down the plug cover 2. The term "plug" always refers to the multifunctional plug. The external wires 6 introduced into the plug base body 1 are stripped of insulation, and the electrical connection with the internal wires 4 is established via the blade contacts 3.

State 2: Position 2 or state 2 is achieved by pushing the plug cover 2 in further. The external wires 6 and the internal wires 4 are thus no longer connected by the shorting jumper 5; i.e., the short circuit is eliminated (see FIGS. 5A and 5B). This occurs due to the short-circuit plunger 11, which pushes the shorting jumper 5 away from the electrical contact, i.e., the blade contact 3, on one side.

FIGS. 2A and 2B show the multifunctional plug in the stored and/or transport state. No external wires 6 are connected.

To use the igniter, the external wires 6 are introduced into the plug base body 1 (FIGS. 3A and 3B). The external wires 6 do not need to be stripped of insulation beforehand. When this has occurred, the plug is brought into its position 1 (FIGS. 4A and 4B) by pushing in the plug cover 2, i.e., by an action of force. During this actuating process the external wires 6 are stripped of insulation and connected to the internal wires 4 in an electrically conductive manner. The short circuit as a result of the shorting jumper 5 is thus maintained.

Position 2 is achieved (FIGS. 5A and 5B) by pushing the plug cover 2 in further. During this actuating process the shorting jumper 5 is opened, so that the short circuit is also eliminated. The igniter may now be used.

The function plunger 13 may have two circumferential grooves 12 on its outer periphery, into which a sealing ring is inserted in each case (not shown in the figures for the sake of simplicity). An optional, further, or additional seal may be achieved, for example, via a gel-like medium in the plug.

The invention claimed is:

1. Igniter for seismic prospection, for mining applications, or for use in the crude oil or natural gas industry, having a detonator in which an explosive material, an igniting element, and an internal wire for initializing the igniting element are situated, the internal wires leading into a plug situated at one end of the detonator, comprising:

a multifunctional plug comprising:

a plug base body and a plug cover which is displaceable in the plug base body, the plug cover being displaceable from a first actuating stage into a second actuating stage;

a receiving channel situated in and extending into the plug base body for introducing an external wire to a slot-shaped blade contact situated in the plug base body; and a pressure plunger situated on the plug cover, which in the first actuating stage does not protrude into the receiving channel, but which in the second actuating stage protrudes into the receiving channels and displaces the external wire, introduced at that location, perpendicularly with respect to the receiving channel, wherein the blade contacts being connected to the internal wire, and in the second actuating stage the pressure plunger pushing the external wires into the blade contact in such a way that the blade contact strips the insulation from the external wire and establishes an electrical connection of the external wire with the internal wires.

2. The igniter according to claim 1, further comprising a shorting jumper situated in the plug base body, and in the first actuating stage short-circuits the internal wires and/or the blade contact, and in the second actuating stage a short-circuit plunger situated on the plug cover releases the shorting jumper from the internal wires and/or the blade contact and eliminates the short circuit.

3. The igniter according to claim 2, wherein the shorting jumper is spring-loaded, or is a spring element which in the second actuating stage is pushed away from the electrical contact by the short-circuit plunger against the elastic force thereof.

4. The igniter according to claim 1, wherein the plug base body and the plug cover comprise a cylindrical design.

5. The igniter according to claim 4, wherein the plug cover has at least one circumferential groove on its peripheral surface for accommodating at least one sealing ring configured to seal the plug cover with respect to the plug base body.

6. The igniter according to claim 1, wherein the plug cover has a function plunger by means of which the plug cover is guided in the plug base body, and on its side facing away from the plug base body the function plunger has an actuating plate which abuts against the plug base body in the second actuating stage.

7. The igniter according to claim 6, wherein the pressure plunger and a short-circuit plunger are situated on the side of the function plunger facing the plug base body, and the actuating plate is situated on the other side.

8. The igniter according to claim 7, wherein at least one pressure plunger is situated in each case in front of and behind the blade contact in the direction of the receiving channels.

9. The igniter according to claim 1, wherein the plug base body is filled with a water-repellent, gel-like medium for protection against penetrating moisture.

10. The igniter according to claim 1, wherein the plug base body and the plug cover are plastic parts.

* * * * *

UNITED STATES PATENT AND TRADEMARK OFFICE

CERTIFICATE OF CORRECTION

PATENT NO. : 8,960,093 B2
APPLICATION NO. : 14/111310
DATED : February 24, 2015
INVENTOR(S) : Frank Haron Preiss et al.

It is certified that error appears in the above-identified patent and that said Letters Patent is hereby corrected as shown below:

IN THE CLAIMS:
On Column 5, Line 47, delete “s” from the word “wire”;
On Column 6, Line 13, delete “s” from the word “wire”;
On Column 6, Line 16, delete “s” from the word “wire”;
On Column 6, Line 19, delete “s” from the word “wire”; and
On Column 6, Line 22, delete “s” from the word “wire”.

Signed and Sealed this
Fourth Day of August, 2015

Michelle K. Lee

Michelle K. Lee
*Director of the United States Patent and Trademark Office*